US008811123B2

(12) United States Patent
Gough et al.

(10) Patent No.: US 8,811,123 B2
(45) Date of Patent: Aug. 19, 2014

(54) WATERPROOF ADHESIVE DECAL CONTAINING AN EMBEDDED DIGITAL CLOCK AND THERMOMETER

(71) Applicant: Surfdyle, Santa Monica, CA (US)

(72) Inventors: Travis Gough, Santa Monica, CA (US); Greg Siefkin, Woodland Hills, CA (US)

( * ) Notice: Subject to any disclaimer, the term of this patent is extended or adjusted under 35 U.S.C. 154(b) by 9 days.

(21) Appl. No.: 13/644,439

(22) Filed: Oct. 4, 2012

(65) Prior Publication Data

US 2014/0036638 A1 Feb. 6, 2014

Related U.S. Application Data

(60) Provisional application No. 61/678,965, filed on Aug. 2, 2012.

(51) Int. Cl.
*G04B 47/00* (2006.01)

(52) U.S. Cl.
USPC ..... 368/10

(58) Field of Classification Search
USPC ..... 368/10, 276, 281–283, 291, 109, 110, 368/69, 88, 204, 286, 203, 239, 241
See application file for complete search history.

(56) References Cited

U.S. PATENT DOCUMENTS

| | | | | | |
|---|---|---|---|---|---|
| 2,227,131 | A * | 12/1940 | Friedman | ..... | 368/281 |
| 4,779,249 | A * | 10/1988 | Rappaport | ..... | 368/276 |
| 4,916,679 | A * | 4/1990 | Agnello | ..... | 368/283 |
| 6,118,426 | A * | 9/2000 | Albert et al. | ..... | 345/107 |
| 6,604,854 | B1 * | 8/2003 | Limburg et al. | ..... | 374/162 |
| 6,621,766 | B2 * | 9/2003 | Brewer et al. | ..... | 368/82 |
| 6,728,166 | B2 * | 4/2004 | Grupp | ..... | 368/69 |
| 7,029,170 | B2 * | 4/2006 | Bailey | ..... | 368/276 |

* cited by examiner

*Primary Examiner* — Edwin A. Leon
(74) *Attorney, Agent, or Firm* — DLA Piper LLP (US)

(57) ABSTRACT

A waterproof adhesive decal containing an embedded digital clock and thermometer is disclosed.

19 Claims, 3 Drawing Sheets

WATERPROOF ADHESIVE DECAL CONTAINING AN EMBEDDED DIGITAL CLOCK AND THERMOMETER

PRIORITY CLAIM

This application claims priority under 35 U.S.C. Section 119 and 120 to U.S. Provisional Patent Application Ser. No. 61/678,965 filed on Aug. 2, 2012, which is incorporated by reference herein.

TECHNICAL FIELD

A waterproof adhesive decal containing an embedded digital clock and thermometer is disclosed.

BACKGROUND OF THE INVENTION

Waterproof watches are well-known in the art. However, it is not convenient to use a waterproof watch in certain activities, such as while surfing, body boarding, snowboarding, or performing other types of water or snow activities. For example, when a user wears snow gear and is in the act of snowboarding, it is not practical to look at a watch to determine the time. Similarly, a wristwatch often can get in the way while surfing and is easily lost or broken upon contact with rocks, a reef, the board itself, etc.

What is needed is a waterproof clock with a thin form factor that can adhere to a surfboard, snowboard, or other apparatus in a manner that does not interfere with the activity itself.

SUMMARY OF THE INVENTION

The aforementioned problems and needs are addressed by a waterproof adhesive decal that contains a digital clock and thermometer embedded within its layers. The decal can adhere to a surfboard, snowboard, or other apparatus.

DETAILED DESCRIPTION OF THE PREFERRED EMBODIMENTS

Figure 1:
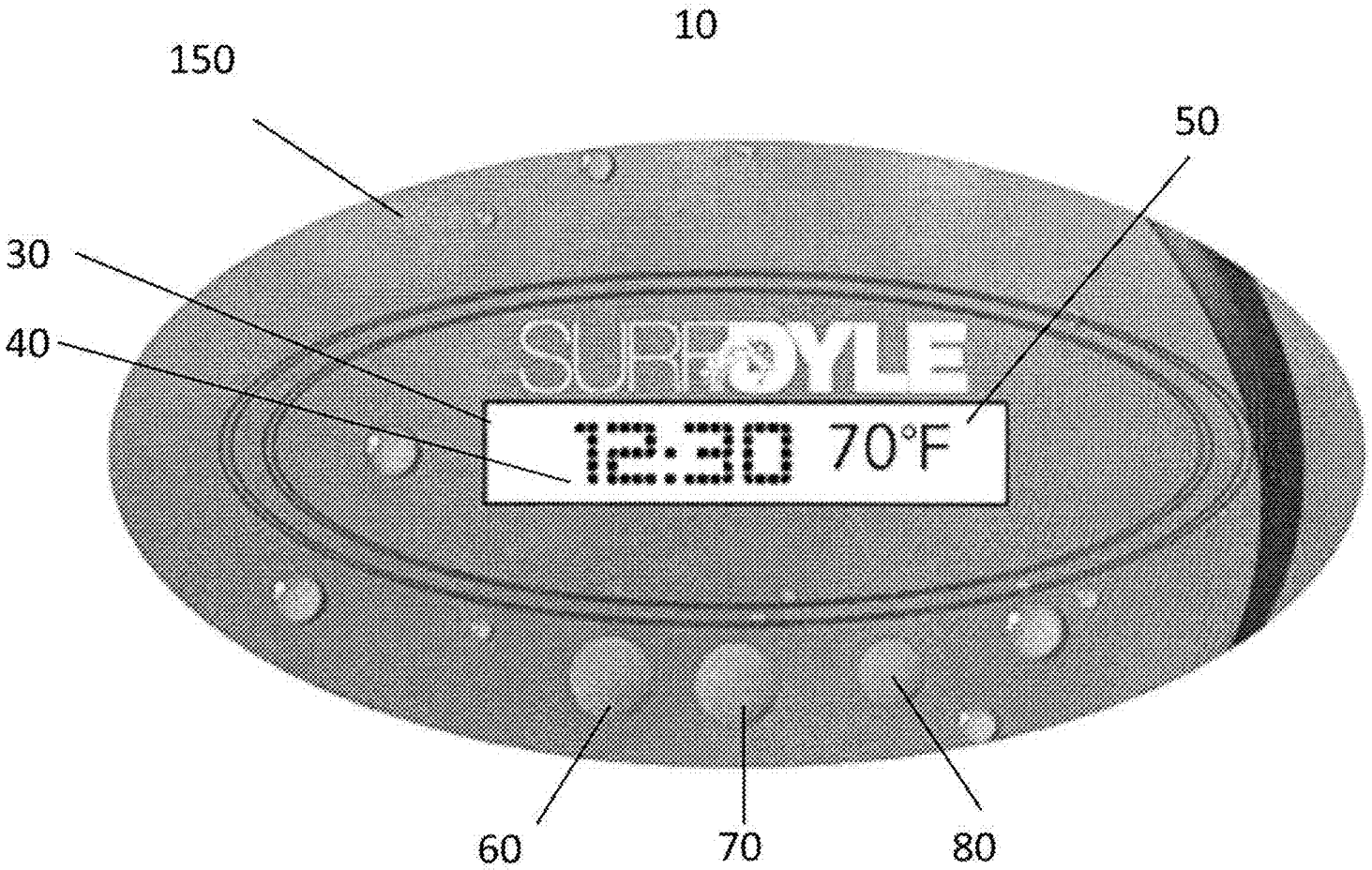
FIG. 1 depicts a front view of an embodiment of a digital apparatus.

An embodiment is shown in FIG. 1. The front face of digital apparatus 10 is shown. Digital apparatus 10 comprises a top layer 150, a display 30, selection device 60, selection device 70, and selection device 80. The body preferably is constructed from a waterproof material such as rubber, plastic, or laminate.

In this example, selection device 60, selection device 70, and selection device 80 each comprise a blister button that can be pressed by a user to make a selection.

Display 30 optionally is a digital LCD or LED display that comprises clock sub-display 40 and temperature sub-display 50. Clock sub-display 40 displays the current time, and temperature sub-display 50 displays the current temperature of digital apparatus 10. Display 30 optionally includes a backlighting feature, which is useful for viewing at night or underwater.

In this example, if selection device 60 is pressed, clock sub-display 40 will begin blinking. Pressing selection device 70 will change the hours digits of clock sub-display 40, and pressing selection device 80 will change the minutes digits of clock sub-display 40.

Figure 2:
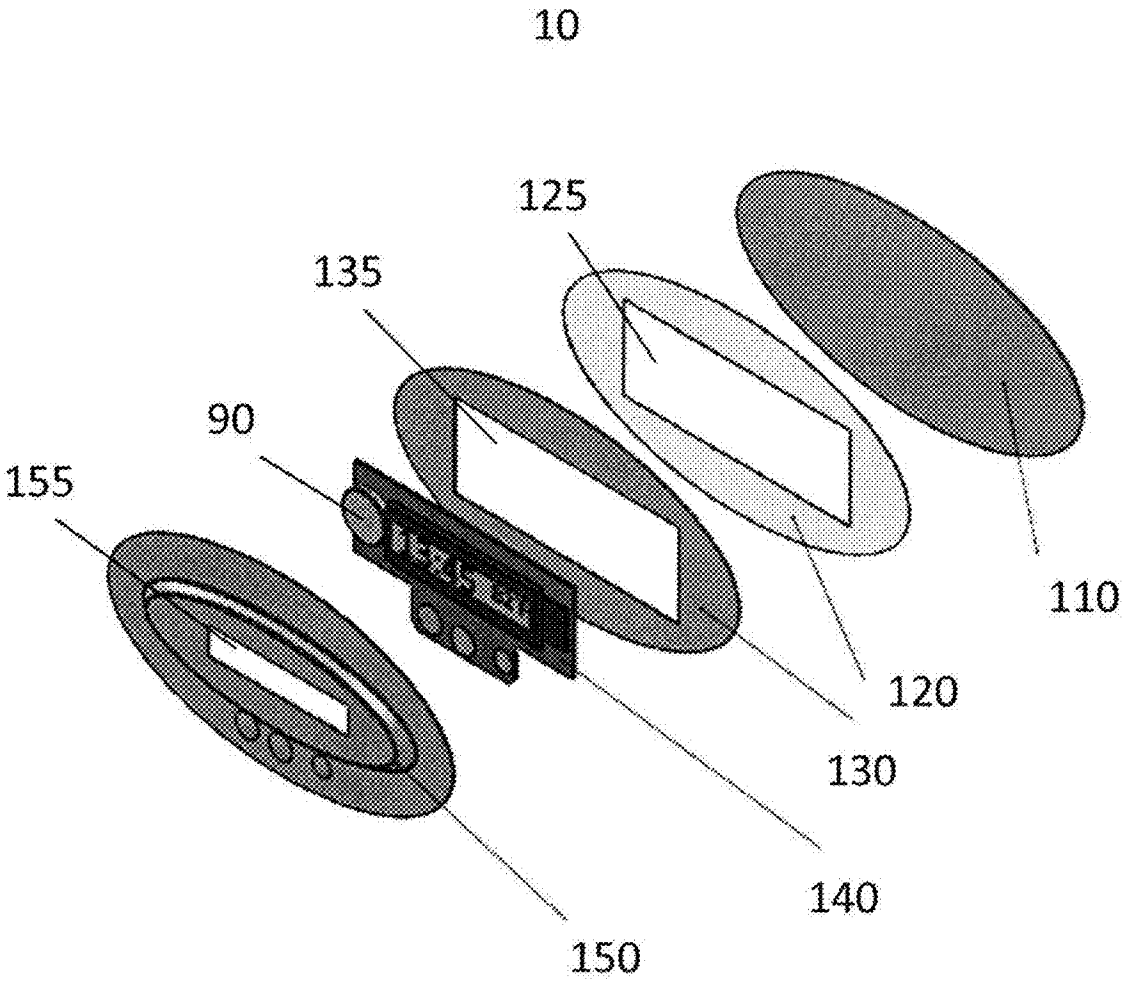
FIG. 2 depicts an exploded view of various layers within a digital apparatus.

Another view of digital apparatus 10 is shown in FIG. 2. Here, an exploded view is shown of various layers contained within digital apparatus 10.

Base layer 110 is a waterproof material, such as a laminate, with an adhesive on its bottom side. Thus, base layer 110 can be attached to another surface, such as the surface of a surfboard, snow board, or other device.

First spacer layer 120 adheres to base layer 110 using glue or adhesive. First spacer layer 120 optionally comprises opening 125 which can accommodate circuit assembly 140.

Second spacer layer 130 adheres to first space layer 120 using glue or adhesive. Second spacer layer 130 optionally comprises opening 135 which can accommodate circuit assembly 140. Opening 125 and opening 135 optionally are co-extensive in area.

Circuit Assembly 140 comprises battery 90. Battery 90 optionally is a lithium ion battery. Circuit Assembly 140 comprises a membrane switch assembly, which further comprises display 40 and the undersides of selection devices 60, 70, and 80. Circuit Assembly 140 comprises circuitry (not shown) for providing a digital clock and thermometer function, such as an ASIC with clock and temperature functionality. Such circuitry is well-known in the art. Circuit assembly 140 is coupled to battery 90 and is powered by battery 90. Circuit assembly 140 comprises a device for detecting temperature, such as a thermometer, which also is well-known in the art.

Top layer 150 attaches to second spacer layer 130 using glue or adhesive. In a preferred embodiment, top layer 150 encloses the perimeter of circuit assembly 140 to form a hermetic seal around circuit assembly 140 in conjunction with second spacer layer 130, first spacer layer 120, and base layer 110 that is waterproof. A waterproof feature is desired because circuit assembly 140 will not operate properly when exposed to water.

Top layer 150 optionally comprises a spacer and/or dome retainer for providing additional space to house circuit assembly 140. Top layer 150 comprises a window 155 in which to allow a user to view display 40. Window 155 optionally can be covered with a coating for protecting window 155 against scratches, heat, water, or glare. Top layer 150 comprises a graphic overlay with subsurface printed text/graphics and a polyester or polycarbonate layer with or without embossed keys. Top layer 150 comprises an electrostatic discharge (ESD) shield layer to shield the digital apparatus 10 from ESD.

Figure 3:
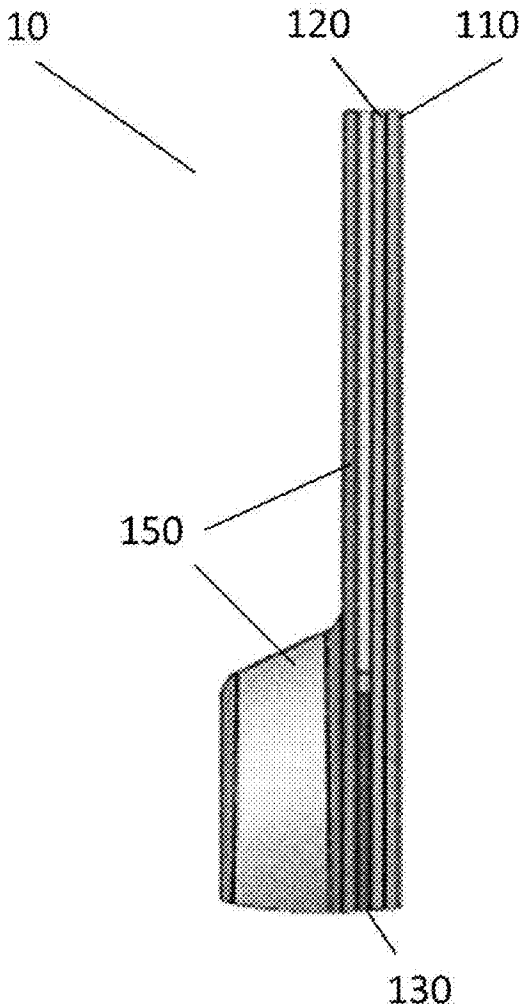
FIG. 3 depicts a side view of an embodiment of a digital apparatus.

A side view of digital apparatus 10 is shown in FIG. 3. Base layer 110, first spacer layer 120, second spacer layer 130, and top layer 150 are shown from a side view. Circuit assembly 140 is not shown because it is completely enclosed by base layer 110, first spacer layer 120, second spacer layer 130, and top layer 150.

The thickness of first spacer layer 120, second spacer layer 130, and top layer 150 are selected to ensure that circuit assembly 140 will fit within the space created by top layer 150, second space layer 130, and first spacer layer 120. In one embodiment, the height of circuit assembly 140 is 1.5 mm. In one embodiment, the thickness of digital device 10 is 1-2 mm.

In another embodiment, first spacer layer 120 and second spacer layer 130 can be replaced by a single, thicker layer that with top layer 150 is thick enough to accommodate circuit assembly 140.

In another embodiment, first space layer 120 and second spacer layer 130 are eliminated altogether, and top layer 150 connects directly to base layer 110, such that top layer 150 and base layer 110 envelop circuit assembly 140 to create a hermetic, waterproof seal.

Through these embodiments, a user of digital device 10 will be able to easily determine the current time and temperature in various environments and conditions, such as when surfing or snowboarding.

Although described with reference to surfboards and snowboards, digital device 10 can be attached to any board or hard surface and will be useful in any environment where a thin form factor is desirable. For instance, another use of digital device 10 is to adhere it to coolers, school binders, bicycles, flashlights, and helmets.

In another embodiment, digital apparatus 10 comprises a sub-assembly for providing data regarding the ocean tides, such as indicating the time of day in which high tide and/or low tide will occur and whether the tide is rising or falling at a particular time.

In another embodiment, digital apparatus 10 comprises a stopwatch function.

In another embodiment, digital apparatus 10 comprises a GPS unit.

What is claimed is:

1. A waterproof adhesive decal containing an embedded digital device, comprising:

a base layer with adhesive on a first side for attaching to a surface;

a circuit assembly comprising a device for generating the current time and a thermometer for generating the current temperature;

a display for displaying the current time and the current temperature;

a top layer connected directly or indirectly to the base layer;

wherein a hermetic and waterproof seal surrounds the circuit assembly.

2. The digital device of claim 1, further comprising a first spacer layer between the base layer and top layer.

3. The digital device of claim 2, further comprising a second spacer layer between the first spacer layer and the top layer.

4. The digital device of claim 1, wherein the thickness of the digital device is 2 mm or less.

5. The digital device of claim 1, further comprising a plurality of selection devices for setting the current time.

6. The digital device of claim 1, wherein the display is an LED display.

7. The digital device of claim 6, wherein the display comprises a backlight.

8. The digital device of claim 1, further comprising a membrane switch.

9. The digital device of claim 1, further comprising a battery.

10. A waterproof adhesive decal containing an embedded digital device, comprising:

a base layer with adhesive on a first side for attaching to a surface;

a circuit assembly comprising a device for generating the current time and temperature;

a display for displaying the current time and temperature with backlighting;

a top layer connected directly or indirectly to the base layer;

wherein a hermetic and waterproof seal surrounds the circuit assembly.

11. The digital device of claim 10, further comprising a first spacer layer between the base layer and top layer.

12. The digital device of claim 11, further comprising a second spacer layer between the first spacer layer and the top layer.

13. The digital device of claim 10, wherein the thickness of the device is 2 mm or less.

14. The digital device of claim 10, further comprising a plurality of selection devices for setting the current time.

15. The digital device of claim 10, wherein the display is an LED display.

16. The digital device of claim 15, wherein the display comprises a backlight.

17. The digital device of claim 10, further comprising a thermometer.

18. The digital device of claim 10, further comprising a membrane switch.

19. The digital device of claim 10, further comprising a battery.

* * * * *